US010793348B2

(12) United States Patent
Koskinen

(10) Patent No.: US 10,793,348 B2
(45) Date of Patent: Oct. 6, 2020

(54) PACKAGE FOR A BEVERAGE PREPARATION

(75) Inventor: Matti Koskinen, Tampere (FI)

(73) Assignee: Spotless Tea Bag Oy, Tampere (FI)

( * ) Notice: Subject to any disclaimer, the term of this patent is extended or adjusted under 35 U.S.C. 154(b) by 805 days.

(21) Appl. No.: 13/642,926

(22) PCT Filed: Apr. 15, 2011

(86) PCT No.: PCT/FI2011/050336

§ 371 (c)(1),
(2), (4) Date: Oct. 23, 2012

(87) PCT Pub. No.: WO2011/131832

PCT Pub. Date: Oct. 27, 2011

(65) Prior Publication Data

US 2013/0040019 A1 Feb. 14, 2013

(30) Foreign Application Priority Data

Apr. 23, 2010 (FI) ..... 20100206 U

(51) Int. Cl.
*B65D 85/808* (2006.01)

(52) U.S. Cl.
CPC ..... *B65D 85/8085* (2013.01)

(58) Field of Classification Search
CPC ..... B65D 85/8085; B65D 85/808
USPC ..... 426/77; 383/121
See application file for complete search history.

(56) References Cited

U.S. PATENT DOCUMENTS

| | | | | |
|---|---|---|---|---|
| 2,334,156 | A | 11/1943 | Hansen | |
| 3,175,911 | A | 3/1965 | Rambold | |
| 2005/0069230 | A1* | 3/2005 | Takahashi | B31B 29/00 383/104 |

FOREIGN PATENT DOCUMENTS

| | | | | |
|---|---|---|---|---|
| DE | 9419497 | U1 | 2/1995 | |
| DE | 29609717 | | 8/1996 | |
| DE | 296 09 717 | * | 9/1996 | B65D 75/38 |
| FR | 2854881 | A1 | 11/2004 | |
| JP | S56-104416 | U | 1/1980 | |
| JP | S59-87469 | U | 6/1984 | |
| JP | S60-161074 | U | 10/1985 | |

(Continued)

OTHER PUBLICATIONS

Teepack Spezialmaschinen, DE 296 09 717, Sep. 1996, Machine Translation.*

(Continued)

*Primary Examiner* — Viren A Thakur
*Assistant Examiner* — C A Smith
(74) *Attorney, Agent, or Firm* — Ziegler IP Law Group, LLC

(57) ABSTRACT

A package containing solid raw material for a beverage, wherein the raw material is packed in a water permeable filter bag (1) and the filter bag is packed in an openable protective package (2) enclosing the bag and having a front wall (2*d*) and a rear wall (2*e*) which are connected at their both vertical edges. The protective package (2) can be opened by forming an opening between the front wall and the rear wall. Both the front wall (2*d*) and the rear wall (2*e*) end at their respective supporting edges (2*a*, 2*b*) at the bottom, and said supporting edges can be brought apart to form a bottom structure to keep the bag upright. At least between the supporting edges, the package material forms a bottom that is liquid tight throughout.

8 Claims, 4 Drawing Sheets

(56) References Cited

FOREIGN PATENT DOCUMENTS

| | | | | | |
|---|---|---|---|---|---|
| JP | H034574 | U | | 1/1991 | |
| JP | 03-4574 | | * | 3/1991 | ..... B65D 77/00 |
| KR | 20080053916 | A | | 6/2008 | |
| WO | 1992/22474 | A1 | | 12/1992 | |
| WO | 2007/081266 | A1 | | 7/2007 | |
| WO | 2007/138335 | A1 | | 12/2007 | |

OTHER PUBLICATIONS

Teepack Spezialmaschinen, DE 296 09 717, Sep. 1996, Translation.*

Yoshizawa, JP 03-4574, Jan. 1991, Translation.*

Pyramid Tea Bags, JAY, [on line] 2009, retrieved May 9, 2017. Retrieved from the Internet: URL:<http://www.jaytea.com/pyramid-tea-bags>.*

Tea's Got a Brand New Bag, New York Times, [on line] Sep. 13, 2006, retrieved May 9, 2017. Retrieved from the Internet: URL:<http://www.nytimes.com/2006/09/13/dining/13tea.html>.*

Burned Tea Thumbs: Lipton Pyramid Tea Bags, David Boles, [on line] Oct. 14, 2006, retrieved May 9, 2017. Retrieved from the Internet: URL<https://bolesblogs.com/2006/10/14/burned-tea-thumbs-lipton-pyramid-tea-bags/>.*

Extended European Search Report received for European Patent Application No. EP11771637.3, dated May 28, 2014, 6 pages.

European Office Action dated May 19, 2015 for European patent application No. 11 771 637.3-1708.

Examination Report received for Indian Patent Application No. 3650/KOLNP/2012, dated Sep. 27, 2018, 7 pages.

* cited by examiner

PACKAGE FOR A BEVERAGE PREPARATION

FIELD OF THE INVENTION

This invention relates to a package for a beverage preparation, comprising a water permeable filter bag for solid raw material for a beverage, packed in an openable protective package enclosing the bag and having a front wall and a rear wall which join together at their both vertical edges, wherein the protective package can be opened by forming an opening between the front wall and the rear wall.

BACKGROUND OF THE INVENTION

The above-mentioned packages comprise solid raw material for a beverage to be prepared by brewing or extracting, in a water permeable bag (filter bag) which is, in turn, packed in package material enclosing the bag and forming a single protective package for the filter bag. Such protective packages may be packed in a larger box-like sales package. The most common examples of such packages are packages of tea beverages to be prepared by brewing or extracting, that is, packages of tea bags. A conventional rectangular flat protective package, to which the string of the tea bag is also fastened, is disclosed, for example, in U.S. Pat. No. 3,175,911.

For using such a bag made of a suitable filter material, it is placed in a cup into which hot water is poured or which already contains hot water, after which the bag is infused in the water as long as the components of the beverage dissolve from the raw material contained in the filter bag to have a desired concentration in the water in the cup.

Problems with such packages are caused by the fact that the raw material inside the filter bag becomes wet and swells when it is infused. When the bag is taken out of the cup, it messes up places. If one wants to drain leftover liquid into the cup by squeezing the bag, this is difficult without staining one's hands, if no appliances are used. Even if the bag had been made dryer by squeezing, some liquid is always left in it, dribbling from the bag onto the surface on which the bag is placed. The bag cannot be inserted easily back to its package, because the bag has swollen when water has been absorbed into the raw material for the beverage.

A number of patent documents disclose solutions to overcome these problems. A very common approach to overcome the problem is to make the package of the bag, in a way, "openable from the bottom", so that the bag can be lowered from the string that carries it into the cup and lifted by the string back into the package, wherein the package can be used to squeeze the bag without staining one's fingers, and for holding the bag. However, it is difficult to pull the swollen bag into the package, if the package is dimensioned to fit closely the dimensions of the dry bag. Furthermore, liquid can still run through the bottom of the package, if the package is placed in a horizontal position.

Document FR-2854881 A1 discloses a flat-bottomed protective package for a tea bag, made of a material similar to liquid packaging board by folding it to form a package with a general shape of a parallelepiped in such a way that its upper part tapers in a wedge-like manner to form a straight edge resembling the closed mouth of a bag. At this location, the package can be opened by tearing the edge open. The string of the tea bag has been threaded through a hole in the flat bottom. When the package is opened, it is turned the bottom up, wherein the tea bag can be lowered down into a cup and lifted up into the pouch with the string, and if desired, beverage can be drained from the bag by squeezing it with the help of the package. The used tea bag can be held in the same package which stands upright, supported by its flat bottom. Although the package is made of a liquid tight material, the bottom through hole for the string causes problems, because some beverage can still leak through it, particularly if the bag has not been squeezed sufficiently dry. Furthermore, the through hole for the string is difficult to implement in the manufacture, in view of mass production. The protective package resembling packages for ready-to-drink beverages takes a lot of space and requires a lot of package material. The package is also so large in volume that the bag is not easy to squeeze with it.

U.S. Pat. No. 2,334,156 discloses a space-saving protective package for a tea bag, which package is flat when packed but can be unfolded to a box-like package having a flat bottom and being open at the top. This has been implemented by means of a number of folds in the package material. The infused tea bag can be inserted back into the opened package, but squeezing it drier with the help of the package is difficult, because of the volume of the package. Due to the method of forming, the package requires a lot of package material.

SUMMARY OF THE INVENTION

It is an aim of the invention to eliminate said drawbacks and to present a package which is easy to use, does not take a lot of space, for example in larger sales packages, and which does not require a lot of package material or complex manufacturing methods, but by means of which tea bags can be used in a neat way.

To achieve this aim, the package according to the invention is primarily characterized in that both the front wall and the rear wall end at their respective supporting edges at the bottom, and said supporting edges can be brought apart to form a bottom structure keeping the bag upright, and that at least between the supporting edges, the package material forms a completely liquid tight bottom.

By pressing, for example, the vertical edges of the package closer to each other, the supporting edges of the bottom can be brought apart in a direction perpendicular to said pressing direction, to form an approximately oval bottom structure, which supports the protective package in an upright position. In a corresponding manner by pressing the side edges, the opening at the top of the package can be expanded in such a way that the infused tea bag can be easily inserted in it. The protective package stands well upright, supported by the bottom expanded by the supporting edges, and the liquids drizzling from the wetted material of the filter bag do not leak anywhere.

When the filter bag is packed in the protective package, the package does not take space any more than a conventional flat package for a tea bag, in view of transport, storage and sales. A large number of such protective packages can be packed densely in larger sales packages.

BRIEF DESCRIPTION OF THE DRAWINGS

In the following, the invention will be described in more detail with reference to the appended drawings, in which.

DETAILED DESCRIPTION OF THE INVENTION

Figure 1:
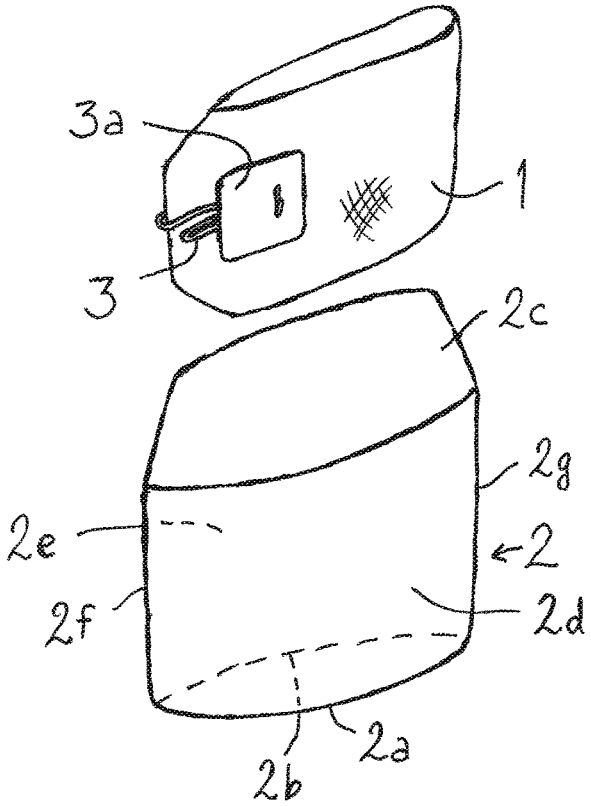
FIG. 1 shows a package in a perspective view, with the elements apart.
Figure 2:
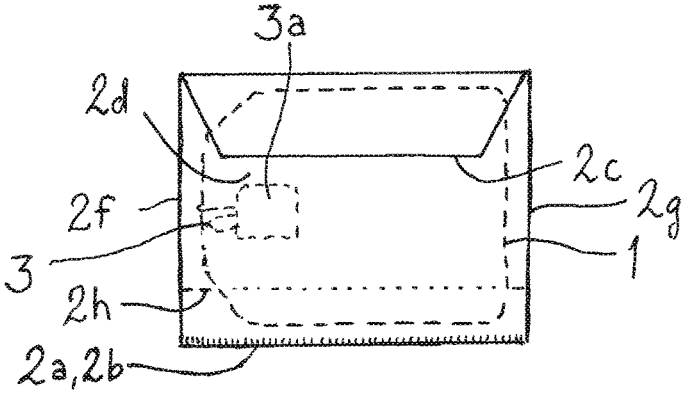
FIG. 2 shows the package in a closed position, seen from the front.
Figure 6:
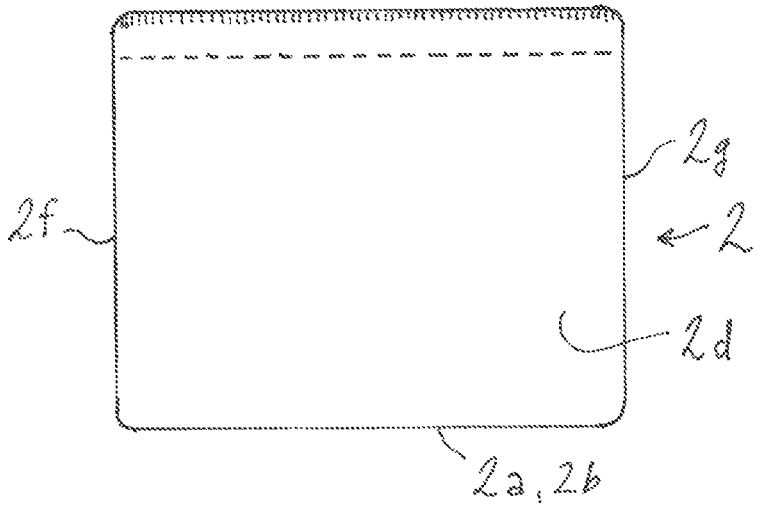
FIG. 6 shows a fully sealed protective package in closed position where the front wall and the rear wall are seamed together at their upper edges.
Figure 7:
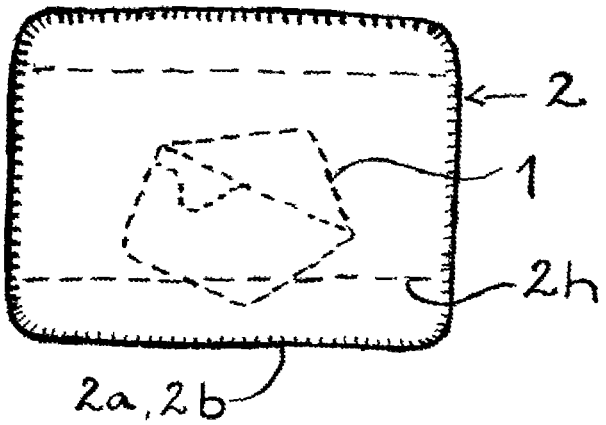
FIG. 7 shows a fully sealed protective package in closed position enclosing a polyhedral filter bag.

FIG. 1 shows a package which comprises a water permeable filter bag 1 which is packed in an openable protective package 2 enclosing the bag. The filter bag contains solid beverage preparation, for example powder or granules or various vegetable parts, from which a beverage can be prepared by infusing the bag 1 in water for a suitable time, wherein the components of the beverage dissolve from it in the water. Tea and various spiced teas and herbal teas are one example, but the invention is not limited solely to packages containing the raw materials for such beverages. The function of the protective package 2 is to protect the bag 1, and if it is fully sealed, also to act as a protection for the aroma. FIG. 2 shows best how the protective package 2 is rectangular, seen in a direction perpendicular to its plane, wherein it comprises a lower edge, side edges and an upper edge. The protective package 2 has a front wall 2*d* and a rear wall 2*e* which join together at their both vertical edges 2*f*, 2*g* which form said side edges. The protective package 2 can be opened by forming an opening at the upper edge, between the front and rear walls 2*d*, 2*e*. In FIGS. 1 to 4, the openability is implemented by means of a flap 2*c* folded from the rear wall onto the front wall, but it is possible that the front wall and the rear wall are attached to each other at the top, forming a tight sealing, and the opening between the front wall and the rear wall for taking out the bag is formed by tearing the protective package 2 open at a pre-marked location, wherein one of the vertical edges 2*f*, 2*g* may be provided with a serration or a corresponding point for starting the tearing close to the upper edge of the protective package. The front wall and the rear wall attached to each other at the top, forming a tight sealing, and the pre-marked location close to the upper edge of the protective package for opening between the front wall and rear wall for taking out the bag are shown in FIGS. 6 and 7.

Both the front wall 2*d* and the rear wall 2*e* end at their respective supporting edges 2*a*, 2*b* at the bottom, and said supporting edges can be brought apart to form a bottom structure to keep the bag upright. Thus, the lower edge of the protective package consists of two separate supporting edges 2*a*, 2*b* extending in the direction perpendicular to the plane of the package. Between the supporting edges 2*a*, 2*b*, the package material of the protective package 2 forms a bottom that is liquid tight throughout. When the protective package is flat, this bottom between the supporting edges forms a fold 2*h* extending to the inside of the package (upwards), as shown by a broken line in FIG. 2. Each of the supporting edges 2*a*, 2*b* extends as a separate edge from the lower end of the respective vertical edge 2*f*, 2*g*.

Figure 3:
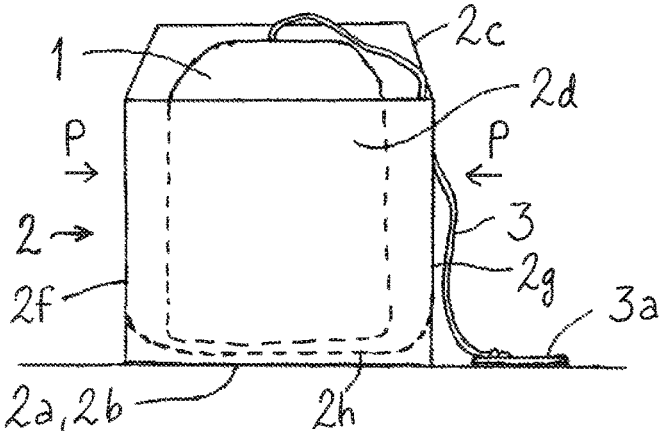
FIG. 3 shows the package in a use situation, seen from the front.
Figure 4:
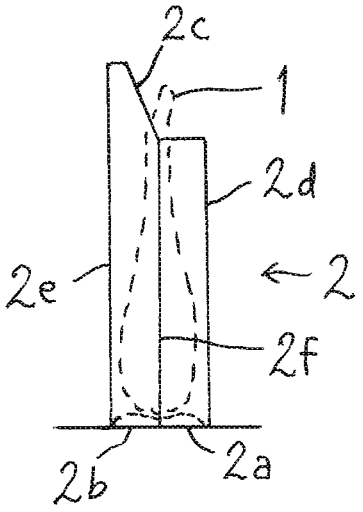
FIG. 4 shows the package in the use situation, seen from the side.

FIG. 2 shows how a conventionally rectangular filter bag 1 is placed horizontally inside the protective package 2, that is, the longer side extending parallel to the bottom. The bag is also fitted at its edge between the front wall 2*d* or the rear wall 2*e* and the fold 2*h* forming the bottom, wherein the bag does not require a large protective package around it but fits inside a smaller protective package 2. The package is, in a way, a normal rectangular tea package, with the difference that it is arranged to be opened from the long side. In a use situation, its one long side is used as a bottom, as shown in FIG. 3. Consequently, the vertical side edges 2*f*, 2*g* of the protective package 2 are the shorter sides, and the lower side and the bottom are the longer sides. This adds to the stability of the package when it is placed upright in a use situation.

After the protective package 2 has been opened and the filter bag 1 has been taken out and infused in water, the empty protective package can be placed on support of the upright bottom, for example, by pressing the package at the side edges, wherein the supporting edges 2*a*, 2*b* of the bottom come apart and the fold 2*h* of the bottom is unfolded. The unfolding of the bottom can be assisted by pressing with a finger from the inside. The bag whose dimensions have increased due to swelling of the solid beverage preparation can then easily be placed, for example by hanging from the string, in an upright position back into the protective package (FIG. 3), because the mouth has also been widened during pressing of the package. Arrows P illustrate pressing in FIG. 3. The bag remains well upright, supported by the supporting edges. Furthermore, the weight of the filter bag 1 increases the stability. All the liquid runs from the filter bag to the bottom of the package and does not leak, thanks to the liquid tight bottom. If desired, the package can also be used for squeezing the rest of the liquids from the bag, by keeping the package upside down and pressing the front and rear walls 2*d*, 2*e* towards each other. In FIG. 3, the package looks narrower than in FIG. 2, because in FIG. 3 the vertical edges 2*f*, 2*g* have been pressed closer to each other to widen the mouth and the bottom.

The edges 2*a*, 2*b* of the lower edge can be simple folds, outside which the package extends upwards in the form of the front wall 2*d* or the rear wall 2*e*, respectively, and, on the inside, in the form of the fold 2*h* of the bottom. Both folds may be provided with a seaming in a narrow horizontal zone, as shown by slashes in FIG. 2; in other words, the package material is sealed together on a short length on both sides of the folding line. This increases the stability of the bottom of the package, because it prevents the fold of the bottom from "popping out" below the supporting edges 2*a*, 2*b*.

In its dimensions, the package of FIG. 2 does not necessarily need to differ from rectangular packages of normal dimensions, wherein the longer sides may be less than 7.5 cm and the shorter sides less than 6.5 cm in a normal situation (in an unopened protective package 2 holding a filter bag 1). Thus, with respect to their requirement for space, the packages of the invention are as suitable for transportation and sales as conventional tea packages. The dimensions may also be greater than those presented above. However, the invention is not, even in other respects, limited to packages of this shape, but it also comprises square packages, as well as packages in which the vertical side edges form the longer sides of a rectangle. It is also possible that the package is slightly trapezoidal in such a way that the side edges are inclined. The dimensions of such a package may also be smaller than 7.5 cm and smaller than 6.5 cm, in which case one of the dimensions is the longer one of the two parallel sides, and the other is the distance between the parallel sides; in other words, if one of the parallel sides is the bottom side, said distance is the height of the protective package 2.

The corners of the above-mentioned quadrangular packages do not need to be abrupt angles, but the corners may be slightly rounded or bevelled. Similarly, the sides do not need to be completely straight, and particularly the upper side may have a curved shape. All these shapes can be produced by separating a blank for the protective package 2 by die cutting or in another way from the package material.

The material for the protective package of the package can be paper which is coated with a water tight coating on the side that will face the inside, wherein also water tightness of the bottom and heat sealability of the package material is provided. The coating may consist of, for example, a barrier plastic. The outer side of the package material is arranged to be printable, wherein it may have a coating that enhances printability. The package material may also be made of a completely water tight material, such as plastic.

Figure 5:
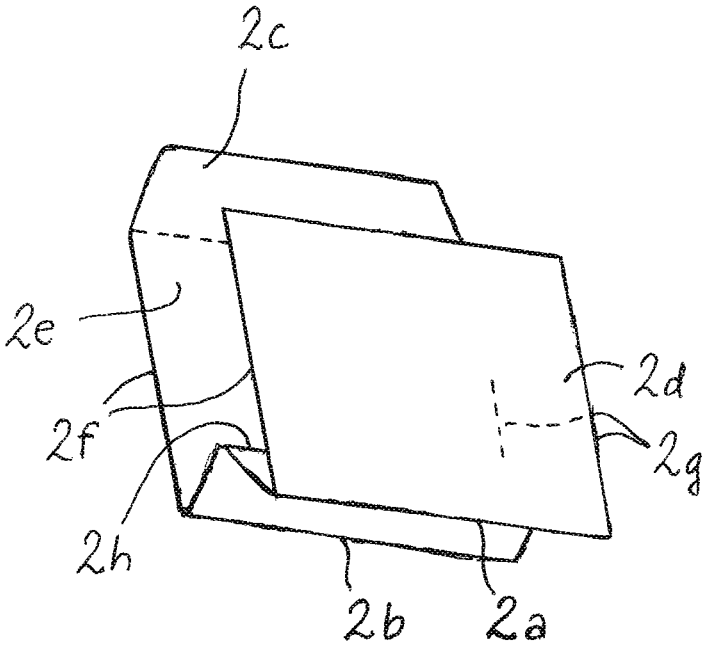
FIG. 5 shows one way of forming the protective package of the package.

FIG. 5 shows a method for making the protective package. The protective package 2 can be made of a single elongated package material blank which is provided with the crosswise folds needed to form the supporting edges 2*a*, 2*b* of the bottom and the fold of the bottom between them. The front wall and the rear wall 2*d*, 2*e* are formed by the blank parts left on both sides of said folds, and the upper end of the front wall is connected by a fold to a flap 2*c* of the same blank, if the mouth of the package is intended to be closed with the flap. After the blank has been folded to form a closed package, its long side edges are seamed together, wherein the vertical edges 2*f*, 2*g* between the front and rear walls 2*d*, 2*e* are formed. At the same time, the fold 2*h* of the bottom is left between the front and the rear walls. If the flap 2*c* is designed so that its side edges are parallel to the edges of the blank, it can also seamed at its edges to the front wall, in the way known from the packages of conventional tea bags. Alternatively, the front wall and the rear wall are seamed together at their upper edges, wherein the mouth between the upper edge and the lower edge is formed by tearing, and for this purpose, the protective package is provided with a mark indicating the point of tearing. The mark indicating the point of tearing is illustrated in the package 2 of FIG. 7, showing a polyhedral filter bag 1 packed in the package 2.

The above-described method can be easily automated, and the filter bag containing the raw material for the beverage can be easily placed inside the package at the step of forming the package, by applying solutions known from methods of packing tea bags. However, the package according to the invention can also be made in another way, for example in such a way that the blank elements forming the front wall and the rear wall are connected to each other via a folding line which forms one of the vertical edges 2*f*, 2*g*, and the other of the vertical edges is formed by seaming the opposite ends of the blank together. The blank part forming the fold of the bottom, and a possible blank part forming a flap, are connected to the front or rear wall.

To increase the inner volume of the protective package, both of the vertical edges 2*f*, 2*g* can be formed by folding the outermost edge of one wall around the outermost edge of the opposite wall, wherein the walls are not seamed together at their inner surfaces. In the method of FIG. 5, this requires a short edge skirt on both the front wall 2*d* and the rear wall 2*e*, or short edge skirts on one of the walls 2*d*, 2*e*, so that the seaming at both of the vertical edges can be performed by folding and attaching the edge skirt onto the outer surface of the opposite wall. Thus, the inner dimension of the protective package 1 in the horizontal direction becomes the whole width of the front and rear walls, but slightly more package material is required for forming the protective package. It is also possible to use separate strips, a kind of an "edge tape", for seaming the front wall and the rear wall together at their edges, so that the inner dimension of the protective package in the horizontal direction becomes the whole width of the front and rear walls.

Packages according to the invention can be packed in parallel, one after the other, in conventional box packages in the same way as conventional tea bags. However, the idea of selling the packages individually is also within the scope of the invention. For example at café s and tea houses, it is possible to sell the individual protective packages of the above-described kind, containing a conventional flat tea bag 1 or a polyhedral bag (for example tetrahedral, so-called pyramid bag) which has recently become more common. The protective bag 2 of such a "three-dimensional" bag can also be of the above-described kind, with the sole difference that it is not as flat when packed and unopened, but it can be used exactly in the same way in the vertical position for holding the bag 1, and the bag can be squeezed with the help of it. A polyhedral bag 1 is illustrated in FIG. 7.

The terms "front wall" and "rear wall" are not intended to be limiting and to limit the "front wall" only to the part with an imprint or a trade mark. For example, in the protective package of FIG. 1, an imprint or a trade mark can be provided on the rear wall 2*e*, and the front wall 2*d* is facing the user when the package is opened with the flap 2*c*. Similarly, a possible imprint does not determine which is the lower edge (bottom) or the upper edge. As an example, we can again take the protective package of FIG. 1, where the imprint on the side of the rear wall 2*e* may be "upside down". However, it is advantageous that the imprint is "the right way up" on the front or rear wall, so that the correct use of the package can be learnt more easily. Instructions for use of the protective package may be printed on the package.

Also in other respects, the invention is not restricted solely to the embodiment shown in the drawings. The filter bag containing the solid raw material for the beverage itself may also have another shape than that described above, for example circular. The bag does not necessarily need to be equipped with a string, in which case it can be dropped by hand into a cup and lifted up with a spoon and placed back into the protective package, by means of which also leftover liquid can be squeezed out of the bag into the cup.

The invention claimed is:

1. A package comprising:

a water permeable polyhedral filter bag containing solid raw material for a beverage packed in said filter bag;

an openable protective package made of a package material, enclosing the bag packed in said protective package and being fully sealed aroma-tight in closed position; said protective package having a front wall, a rear wall, side edges, a lower edge, an upper edge, and a bottom, said front wall and rear wall joining together at their both vertical edges which form the side edges of the protective package and the front wall and the rear wall being seamed together at their upper edges, said protective package being openable by forming an opening between the front wall and the rear wall by tearing the package open at a pre-marked location close to the upper edge of the package, both the front wall and the rear wall ending at their respective separate supporting edges at the bottom, the lower edge of the package in flat, closed position consisting of said separate supporting edges, which can be brought apart to form an expanded bottom structure which keeps the package upright supported by said supporting edges brought apart, and the opening formed for taking out the bag being widenable by pressing the vertical edges closer to each other for placing the bag back into the package, the package material of the protective package forming a bottom that is liquid tight throughout at least between the supporting edges, the package having rectangular form where the vertical edges of the package form shorter sides and the bottom and the opening of the package are formed along longer sides, and both separate supporting edges at the bottom being constituted of folds defined by folding lines, where the package material is sealed together on a short length on both sides of each folding line.

2. The package according to claim 1, wherein the supporting edges can be brought apart by pressing the side edges of the package closer to each other.

3. The package according to claim 1, wherein the bottom between the supporting edges in flat, closed position of the package forms a fold extending to the inside of the package.

4. The package according to claim 1, wherein at the vertical edges the front wall and the rear wall are not seamed together at their inner surfaces, whereby the inner dimension of the package in the horizontal direction becomes the whole width of the front and rear walls.

5. The package according to claim 1, wherein the dimensions of the protective package fit inside a rectangle, whose longer sides are smaller than 7.5 cm and shorter sides are smaller than 6.5 cm.

6. The package according to claim 5, wherein the protective package is a rectangular package whose longer sides are smaller than 7.5 cm and shorter sides are smaller than 6.5 cm.

7. The package according to claim 1, wherein the package material of the protective package is, on the side of the inner part, coated with a water tight coating, or is made of a water tight material.

8. The package according to claim 1, wherein the water permeable polyhedral filter bag is a tetrahedral filter bag.

* * * * *